US010446378B2

(12) United States Patent
Gordon et al.

(10) Patent No.: US 10,446,378 B2
(45) Date of Patent: Oct. 15, 2019

(54) ION INLET ASSEMBLY

(71) Applicant: Micromass UK Limited, Wilmslow (GB)

(72) Inventors: David Gordon, Manchester (GB); Joseph Jarrell, Newton Highlands, MA (US); Daniel James Kenny, Knutsford (GB); Stephen O'Brien, Manchester (GB); Ian Trivett, Cheadle (GB)

(73) Assignee: MICROMASS UK LIMITED, Wilmslow (GB)

( * ) Notice: Subject to any disclaimer, the term of this patent is extended or adjusted under 35 U.S.C. 154(b) by 0 days.

(21) Appl. No.: 15/022,677

(22) PCT Filed: Sep. 17, 2014

(86) PCT No.: PCT/GB2014/052826
§ 371 (c)(1),
(2) Date: Mar. 17, 2016

(87) PCT Pub. No.: WO2015/040392
PCT Pub. Date: Mar. 26, 2015

(65) Prior Publication Data

US 2016/0233070 A1 Aug. 11, 2016

Related U.S. Application Data

(60) Provisional application No. 61/880,403, filed on Sep. 20, 2013.

(30) Foreign Application Priority Data

Oct. 8, 2013 (EP) ..... 13187755
Oct. 8, 2013 (GB) ..... 1317774.6

(51) Int. Cl.
*H01J 49/04* (2006.01)
*H01J 49/06* (2006.01)
*H01J 49/00* (2006.01)

(52) U.S. Cl.
CPC ..... *H01J 49/0422* (2013.01); *H01J 49/0013* (2013.01); *H01J 49/04* (2013.01); *H01J 49/0495* (2013.01); *H01J 49/066* (2013.01)

(58) Field of Classification Search
CPC .... H01J 49/0013; H01J 49/04; H01J 49/0422; H01J 49/0495; H01J 49/066
See application file for complete search history.

(56) References Cited

U.S. PATENT DOCUMENTS 4,184,925 A * 1/1980 Kenworthy ..... B41J 2/162 205/50
4,246,076 A * 1/1981 Gardner ..... B41J 2/162 205/73

(Continued)

FOREIGN PATENT DOCUMENTS

AU 2005284150 B2 5/2011
DE 3028116 2/1982

(Continued)

OTHER PUBLICATIONS

Gentry, W. Ronald, and Clayton F. Giese. "High-precision skimmers for supersonic molecular beams." Review of Scientific Instruments 46.1 (1975): 104-104.*

(Continued)

*Primary Examiner* — Wyatt A Stoffa
(74) *Attorney, Agent, or Firm* — Womble Bond Dickinson (US) LLP; Deborah M. Vernon; Heath T. Misley

(57) ABSTRACT

An ion inlet assembly for connecting to a mass spectrometer housing is disclosed comprising a sampling limiting body having a sampling orifice. The sampling limiting body (Continued)

comprises a nickel disk wherein the disk and sampling orifice are made or formed by an electroforming process.

20 Claims, 4 Drawing Sheets

(56) References Cited

U.S. PATENT DOCUMENTS 5,148,021 A * 9/1992 Okamoto ..... H01J 49/06 250/281
5,352,892 A 10/1994 Modehai et al.
5,440,124 A 8/1995 Kelly et al.
5,462,648 A * 10/1995 Wakabayashi ..... B41J 2/162 205/75
5,495,107 A 2/1996 Hu et al.
5,543,619 A 8/1996 Mullock
5,838,002 A * 11/1998 Sheehan ..... H01J 49/049 250/288
5,986,259 A 11/1999 Hirabayashi et al.
6,657,191 B2 12/2003 Park
6,703,610 B2 3/2004 Mordehai
6,772,649 B2 8/2004 Zimmerman et al.
6,806,468 B2 10/2004 Laiko et al.
6,838,664 B2 1/2005 Sakairi et al.
7,119,330 B2 * 10/2006 Kalinitchenko ..... H01J 49/067 250/288
7,145,136 B2 12/2006 Yang et al.
7,329,863 B2 2/2008 Kalinitchenko
7,411,185 B2 8/2008 Waki
7,435,952 B2 * 10/2008 Finlay ..... H01J 49/0013 250/292
7,462,826 B2 12/2008 Schneider et al.
8,148,681 B2 4/2012 Syms et al.
8,269,164 B2 9/2012 Finlay et al.
9,697,999 B2 * 7/2017 Makarov ..... H01J 49/067
2002/0100714 A1 * 8/2002 Staats ..... B01L 3/5027 210/85
2003/0146378 A1 * 8/2003 Mordehai ..... H01J 49/04 250/288
2005/0151074 A1 * 7/2005 Thakur ..... H01J 49/067 250/288
2005/0269506 A1 * 12/2005 Kalinitchenko ..... H01J 49/067 250/288
2006/0054805 A1 * 3/2006 Flanagan ..... H01J 49/04 250/288
2008/0116371 A1 * 5/2008 Wouters ..... H01J 49/044 250/288
2009/0039251 A1 * 2/2009 Yamada ..... H01J 49/105 250/288
2010/0193677 A1 8/2010 Freedman et al.
2010/0237240 A1 * 9/2010 Watson ..... H01J 49/482 250/305
2010/0320374 A1 12/2010 Jarrell et al.
2011/0085852 A1 * 4/2011 Ferrara ..... F16B 7/20 403/350
2013/0126723 A1 * 5/2013 Ouyang ..... H01J 49/0404 250/282
2014/0217279 A1 * 8/2014 Kenny ..... H01J 49/067 250/283

FOREIGN PATENT DOCUMENTS

EP 1225616 A2 7/2002
JP 62116355 7/1987
JP 10208690 8/1998

OTHER PUBLICATIONS

Barborini et al., "*A Portable Ultrahigh Vacuum Apparatus for the Production and In Situ Characterization of Clusters and Cluster-Assembled Materials*", Review of Scientific Instruments, vol. 73, No. 5, pp. 2060-2066, 2002.
Hayhurst et al., "*Mass Spectrometric Sampling of Ions from Atmospheric Pressure Flames -I: Characteristics and Calibration of the Sampling System*", Department of Chemical Engineering, vol. 28, pp. 67-80, 1977.
Kohno et al., "*Ion Formation to the Gas Phase by Laser Ablation on a Droplet Beam*", Chemical Physics Letters, vol. 420, pp. 146-150, 2006.
Combined Search and Examination Report issued for GB Application No. 1714015.3 dated Nov. 27, 2017.
Pretorius V. et al., "Manufacture, by electroforming, of thin-walled nickel capillary columns for gas liquid chromatography", pp. 17-29.
SCP Science, Jan. 2005, "ICP Emission Spectroscopy ICP Mass Spectrometry", Scpscience.com [online], available from: https://web.archive.org/web/20050131184050/http://scpscience.com:80/Company%20Literature/Pdf/Catalogs/ICP%20Supplies_May%202004.pdf [Accessed Nov. 15, 2017] see p. 46.
"Electroforming." Wikipedia. Mar. 13, 2013. https://en.wikipedia.org/w/index.php?title=Electroforming&oldid=544175088. Retrieved Jan. 18, 2019.
Newman et al. "High sensitivity skimmers and non-linear mass dependent fractionation in ICP-MS." J. Anal. Atomic Spectrometry. 24.6(2009): 742.-751.

* cited by examiner

ION INLET ASSEMBLY

CROSS REFERENCE TO RELATED APPLICATIONS

This application is the National Stage of International Application No. PCT/GB2014/052826, filed 17 Sep. 2014 which claims priority from and the benefit of U.S. patent application No. 61/880,403 filed on 20 Sep. 2013, United Kingdom patent application No. 1317774.6.0 filed on 8 Oct. 2013 and European patent application No. 13187755.7 filed on 8 Oct. 2013. The entire contents of these applications are incorporated herein by reference.

BACKGROUND OF THE PRESENT INVENTION

The present invention relates to an ion inlet assembly, a mass spectrometer, a method of mass spectrometry and a method of manufacturing an ion inlet assembly.

The preferred embodiment relates generally to apparatus and methods for the introduction of ions into a vacuum chamber and more specifically to the introduction of sample ions into the vacuum chambers of a mass spectrometer.

Mass spectrometers can be expensive instruments which can require regular maintenance from skilled users in order to maintain their performance at optimum levels. In many instances this includes the cleaning of a variety of parts. Often, this may involve disassembling parts of the instrument so that the parts can be properly accessed and cleaned. If these parts are elements of the vacuum system then the instrument may require venting, the part(s) reassembled, and then the instrument pumped back to the desired pressure before the instrument is operational again. This can be a time consuming procedure which can result in prolonged down time for the instrument.

One part of the instrument which often requires cleaning is the ion inlet assembly through which ionised sample enters the vacuum region of a mass spectrometer. Contaminants and sample injected into the instrument can stick to the ion inlet assembly's components which can lead to a decreased level of performance of the mass spectrometer.

GB-2438892 (Microsaic) discloses a disposable planar micro-engineered vacuum interface for an electrospray ionization system. The interface is fabricated from silicon using lithography and etching.

It is desired to provide an improved ion inlet assembly.

SUMMARY OF THE PRESENT INVENTION

Accordingly to an aspect of the present invention there is provided an ion inlet assembly for connecting to a mass spectrometer housing comprising:

a sampling limiting body comprising a nickel disk having a sampling orifice, wherein the disk and sampling orifice are made or formed by an electroforming process.

The gas flow through a thin orifice is determined by the square of its radius and so even small imperfections can lead to large changes in gas flow. This has an effect on sensitivity as fewer ions are able to be sampled through the orifice and the pressures in the differentially pumped regions will be effected which can also result in a variation in sensitivity. As the orifice diameters under consideration are of the order of the diameter of a human hair, it takes very little imperfection to have a gross effect. In mass spectrometers which, for example, are designed for general use by inexperienced operators, it is important to minimise any variation so as to produce consistent results. These systems also rely upon feedback from indicators such as the operating power of the vacuum pumps to effectively monitor that the vacuum levels has not exceeded pre-set limits. If an orifice has imperfections or is under/over sized then incorrect feedback may be presented to the user as to the operational condition of their instrument.

It has been found that producing a sampling limiting body comprising a nickel disk having a sampling orifice wherein the disk and sampling orifice are fabricated by an electroforming process results in a significantly improved sampling orifice which is essentially free from imperfections.

The arrangement disclosed in GB-2438892 (Microsaic) relates to a planar microengineered vacuum interface fabricated by lithography and etching of silicon to provide a disposable interface. The approach disclosed in GB-2438892 (Microsaic) is a subtractive process and the microengineered vacuum interface suffers from imperfections especially in the formation of the sampling orifice.

A particularly serious problem with the known arrangement is that the subtractive fabrication process results in the formation of a sampling orifice which is not perfectly smooth and wherein small ribs may remain present around the circumference of the sampling orifice. As a result, there can be significant differences in sensitivity from one conventional vacuum interface to the next i.e. the known microengineered vacuum interface suffers from a considerable degree of variability.

Furthermore, the subtractive nature of the etching process only enables relatively simple designs to be produced.

By contrast, fabricating the sampling limiting body from nickel using an electroforming process enables a sampling limiting body having fine and consistent details to be formed. Also, the variability in performance from one sampling limiting body to the next is significantly reduced according to the present invention.

Another advantage of the present invention is that the sampling limiting body since it is electroformed from nickel is inherently conductive enabling the sampling limiting body to be maintained in electrical contact with an ion block assembly of a mass spectrometer. By contrast, conventional vacuum interfaces fabricated from silicon are not inherently conductive and consideration would need to be give to applying a conductive coating to or plating the vacuum interface.

A further advantage of the electroforming process according to the present invention is that the contour of the sampling orifice can be varied so that, for example, embodiments of the present invention are contemplated wherein the sampling orifice may be formed to include rifling.

The sampling orifice according to the present invention can therefore be relatively easily fabricated so as to have an optimal profile for the intended use. This is not possible within the limited design constraints of the known microengineered vacuum interface e.g. it is not possible to produce a sampling orifice having rifling or other features which are optimal for a desired intended use.

The term "disk" as used in relation to the present invention should not be construed as including a capillary gas limiting orifice i.e. capillary gas limiting orifices do not fall within the scope of the present invention.

The disk is preferably disposable.

The ion inlet assembly may further comprise a gas cone assembly having a gas cone orifice to allow ions to pass therethrough. The gas cone assembly is preferably further arranged to be connectable to a gas supply, wherein the gas is preferably arranged to flow towards the gas cone orifice.

The disk may be flat and/or the disk may be stepped.

The disk is preferably substantially round or circular but less preferred embodiments are contemplated wherein the disk may not be perfectly round or circular.

The sampling limiting body is preferably housed within a sampling limiting body housing which is preferably made of rubber.

The sampling limiting body housing is preferably electrically conductive and the disk is also preferably made of a conductive material. This is particularly advantageous in that it enables the sampling limiting body (nickel disk) to make a good electrical contact with an ion block assembly of a mass spectrometer via the conductive sampling limiting body housing.

The sampling limiting body is preferably arranged to be supplied with a voltage in use.

The sampling orifice is preferably round or circular but other embodiments are also contemplated wherein the sampling orifice is not round or circular.

In some embodiments the sampling limiting body may have more than one sampling orifice.

The ion inlet assembly preferably further comprises a vacuum holding member having an orifice to allow the flow of ions into the mass spectrometer.

According to an aspect of the present invention there is provided an ion inlet assembly for connecting to a mass spectrometer housing comprising:

a sampling limiting body having an orifice wherein the sampling limiting body is made of nickel, and wherein the sampling limiting body and orifice is made or formed by an electroforming process; and a vacuum holding member having an orifice to allow the flow of ions into the mass spectrometer;

wherein upon attachment to the mass spectrometer housing the vacuum holding member provides at least a partial vacuum seal upon removal of the sampling limiting body.

The sampling limiting body preferably comprises a disk.

The ion inlet assembly preferably further comprising a gas cone assembly having an orifice to allow ions to pass therethrough, the gas cone assembly being further arranged to be connected to a gas supply so that gas preferably flows in use towards the gas cone orifice.

The gas cone preferably comprises two or more parts.

The ion inlet assembly is preferably attached to the mass spectrometer housing by a mounting device. The mounting device is preferably attachable to the mass spectrometer housing without the use of mechanical fasteners.

According to another aspect of the present invention there is provided a sampling limiting body suitable for use with an ion inlet assembly as described above.

According to another aspect of the present invention there is provided a vacuum holding member suitable for use with an ion inlet assembly as described above.

According to another aspect of the present invention there is provided a mass spectrometer comprising an ion inlet assembly as described above.

According to another aspect of the present invention there is provided a method of mass spectrometry comprising:

passing ions through an ion inlet assembly of a mass spectrometer, the ion inlet assembly comprising a sampling limiting body comprising a nickel disk having a sampling orifice, wherein the disk and sampling orifice is made or formed by an electroforming process.

Preferably, the method further comprises using a mass analyser to mass analyse the ions.

According to another aspect of the present invention there is provided a method of manufacturing an ion inlet assembly for connecting to a mass spectrometer housing comprising:

using an electroforming process to form a nickel sampling limiting body comprising a disk and wherein the electroforming process also results in the formation of a sampling orifice in the disk.

According to an aspect of the present invention there is provided an ion inlet assembly for connecting to a mass spectrometer housing comprising:

a sampling limiting body having a sampling orifice;

wherein the sampling limiting body comprises a disk.

Preferably, the disk is made of nickel.

Preferably, the disk is made by an electroforming process.

The present invention is concerned with an easily manufactured atmospheric pressure interface for a mass spectrometer. The atmospheric pressure interface is preferably arranged to maintain a degree of vacuum when the gas cone and sampling structure is removed.

The sampling limiting body is advantageously manufactured in a single step electroforming process which is also a clean process. This significantly reduces the cost of the overall manufacturing process and the electroforming process allows for the manufacture of numerous sampling limiting bodies or disks in a routine and highly reproducible manner. Furthermore, the sampling limiting bodies or disks can be routinely manufactured with significantly improved tolerances compared to conventional vacuum interfaces fabricated by lithography and etching of silicon.

The sampling limiting body is preferably a disposable component since it can be produced at relatively low cost and the manufacturing process is highly reproducible compared to conventional arrangements.

The central aperture or sampling orifice can take on one of many different forms. The manufacturing process according to the present invention advantageously allows for the production of non-circular apertures and also the possibility of having multiple apertures which may be positioned close to each other.

The sampling limiting body may be formed in a stepped or multi level geometry for the orifice which is something which is essentially only achievable via electroforming. This may be advantageous to control the tolerance of the orifice size. It will be understood that it is essentially not possible (or at least very difficult) to manufacture stepped or multi level orifices using a conventional silicon etching process.

The sampling limiting body can be arranged so as to be easily capable of visual identification. Visual identification can easily be added to the sampling limiting body during the manufacturing process. For example, it may be desirable to label the sampling limiting body to give details of: (i) the thickness of the sampling limiting body; (ii) the size of the orifice; (iii) the diameter of the disk; (iv) a serial number; or (v) a revision letter or number, a version number or a batch ID reference or number. These properties may be labelled on the upper (front) and/or lower (rear) face of the sampling limiting body. Other embodiments are also contemplated wherein the above properties may be labelled on the side or around the circumference of the disk or sampling limiting body.

The sampling limiting body is preferably manufactured with a high quality surface finish on one or both sides of the sampling limiting body directly from the electroforming process. Advantageously, this removes the need for polishing or cleaning the sampling limiting body which enables the installation of the sampling limiting body straight into the housing and into the ion inlet assembly. According to an embodiment, the initial mandrel or start phase may have a highly polished surface so that the resulting electroformed disk is arranged to have a highly polished finished surface.

Furthermore, if the finish is provided on both sides then this allows the sampling limiting body to be installed in either orientation.

The sampling limiting body advantageously has been found to be exceptionally robust and hard wearing. By way of contrast, conventional ion sampling arrangements are relatively delicate and fragile and may be easily damaged. In particular, conventional arrangements having an inner sampling cone having a small aperture in a sharply pointed cone can easily be damaged or become at least partially blocked either due to mishandling or during cleaning.

Advantageously, the present invention allows the gas cone to be removed whilst the sampling limiting body and vacuum holding member preferably remain in situ. This enables the vacuum within the instrument to be substantially maintained for an extended period of time without the need for an isolation valve.

Advantageously when the sampling limiting body is removed, the vacuum holding member remains in place which enables a level of vacuum to be maintained for a relatively long period of time. Consequently, this significantly reduces the time that the mass spectrometer is off line when the sampling limiting body requires replacing since the vacuum within the mass spectrometer vacuum chambers is only lost very slowly. Furthermore, it removes the requirement for an isolation valve.

The atmospheric pressure interface according to the preferred embodiment preferably comprises a gas cone assembly which is located adjacent to the sampling limiting body. The sampling limiting body is preferably inserted onto the body of an ion block of a mass spectrometer.

The gas cone is advantageously secured to the ion block without the use of mechanical fasteners such as screws or Allen bolts. This removes the possibility of failure of such fasteners or of a user applying insufficient or incorrect tension to such fasteners. Advantageously, no tools are required by a user in order to attach and secure the gas cone assembly to an ion block of a mass spectrometer.

Ions preferably enter a sub-atmospheric pressure region of a mass spectrometer by passing through the gas cone assembly and the inner sampling limiting body before the ions then pass into an internal passage provided within the body of the ion block. The ion block is preferably secured to a main housing of a mass spectrometer and preferably forms a vacuum seal therewith.

The mass spectrometer preferably comprises a miniature mass spectrometer.

Miniature mass spectrometers require a lower vacuum level which results in a lower gas throughput which results in a greater frequency of blockages in the sampling inlet assembly. This increases the requirement for removing, cleaning and replacing the sampling limiting body. The sampling limiting body according to the present invention has been found to be particularly advantageous to use with a miniature mass spectrometer.

According to an embodiment the mass spectrometer may further comprise:

(a) an ion source selected from the group consisting of: (i) an Electrospray ionisation ("ESI") ion source; (ii) an Atmospheric Pressure Photo Ionisation ("APPI") ion source; (iii) an Atmospheric Pressure Chemical Ionisation ("APCI") ion source; (iv) a Matrix Assisted Laser Desorption Ionisation ("MALDI") ion source; (v) a Laser Desorption Ionisation ("LDI") ion source; (vi) an Atmospheric Pressure Ionisation ("API") ion source; (vii) a Desorption Ionisation on Silicon ("DIOS") ion source; (viii) an Electron Impact ("EI") ion source; (ix) a Chemical Ionisation ("CI") ion source; (x) a Field Ionisation ("FI") ion source; (xi) a Field Desorption ("FD") ion source; (xii) an Inductively Coupled Plasma ("ICP") ion source; (xiii) a Fast Atom Bombardment ("FAB") ion source; (xiv) a Liquid Secondary Ion Mass Spectrometry ("LSIMS") ion source; (xv) a Desorption Electrospray Ionisation ("DESI") ion source; (xvi) a Nickel-63 radioactive ion source; (xvii) an Atmospheric Pressure Matrix Assisted Laser Desorption Ionisation ion source; (xviii) a Thermospray ion source; (xix) an Atmospheric Sampling Glow Discharge Ionisation ("ASGDI") ion source; (xx) a Glow Discharge ("GD") ion source; (xxi) an Impactor ion source; (xxth) a Direct Analysis in Real Time ("DART") ion source; (xxiii) a Laserspray Ionisation ("LSI") ion source; (xxiv) a Sonicspray Ionisation ("SSI") ion source; (xxv) a Matrix Assisted Inlet Ionisation ("MAII") ion source; (xxvi) a Solvent Assisted Inlet Ionisation ("SAII") ion source; (xxvii) a Desorption Electrospray Ionisation ("DESI") ion source; and (xxviii) a Laser Ablation Electrospray Ionisation ("LAESI") ion source; and/or (b) one or more continuous or pulsed ion sources; and/or (c) one or more ion guides; and/or (d) one or more ion mobility separation devices and/or one or more Field Asymmetric Ion Mobility Spectrometer devices; and/or (e) one or more ion traps or one or more ion trapping regions; and/or (f) one or more collision, fragmentation or reaction cells selected from the group consisting of: (i) a Collisional Induced Dissociation ("CID") fragmentation device; (ii) a Surface Induced Dissociation ("SID") fragmentation device; (iii) an Electron Transfer Dissociation ("ETD") fragmentation device; (iv) an Electron Capture Dissociation ("ECD") fragmentation device; (v) an Electron Collision or Impact Dissociation fragmentation device; (vi) a Photo Induced Dissociation ("PID") fragmentation device; (vii) a Laser Induced Dissociation fragmentation device; (viii) an infrared radiation induced dissociation device; (ix) an ultraviolet radiation induced dissociation device; (x) a nozzle-skimmer interface fragmentation device; (xi) an in-source fragmentation device; (xii) an in-source Collision Induced Dissociation fragmentation device; (xiii) a thermal or temperature source fragmentation device; (xiv) an electric field induced fragmentation device; (xv) a magnetic field induced fragmentation device; (xvi) an enzyme digestion or enzyme degradation fragmentation device; (xvii) an ion-ion reaction fragmentation device; (xviii) an ion-molecule reaction fragmentation device; (xix) an ion-atom reaction fragmentation device; (xx) an ion-metastable ion reaction fragmentation device; (xxi) an ion-metastable molecule reaction fragmentation device; (xxii) an ion-metastable atom reaction fragmentation device; (xxiii) an ion-ion reaction device for reacting ions to form adduct or product ions; (xxiv) an ion-molecule reaction device for reacting ions to form adduct or product ions; (xxv) an ion-atom reaction device for reacting ions to form adduct or product ions; (xxvi) an ion-metastable ion reaction device for reacting ions to form adduct or product ions; (xxvii) an ion-metastable molecule reaction device for reacting ions to form adduct or product ions; (xxviii) an ion-metastable atom reaction device for reacting ions to form adduct or product ions; and (xxix) an Electron Ionisation Dissociation ("EID") fragmentation device; and/or (g) a mass analyser selected from the group consisting of: (i) a quadrupole mass analyser; (ii) a 2D or linear quadrupole mass analyser; (iii) a Paul or 3D quadrupole mass analyser; (iv) a Penning trap mass analyser; (v) an ion trap mass analyser; (vi) a magnetic sector mass analyser; (vii) Ion Cyclotron Resonance ("ICR") mass analyser; (viii) a Fourier Transform Ion Cyclotron Resonance ("FTICR") mass analyser; (ix) an electrostatic mass analyser arranged to generate an electrostatic field having a quadro-logarithmic potential distribution; (x) a Fourier Transform electrostatic mass analyser; (xi) a Fourier Transform mass analyser; (xii) a Time of Flight mass analyser; (xiii) an orthogonal acceleration Time of Flight mass analyser; and (xiv) a linear acceleration Time of Flight mass analyser; and/or (h) one or more energy analysers or electrostatic energy analysers; and/or (i) one or more ion detectors; and/or (j) one or more mass filters selected from the group consisting of: (i) a quadrupole mass filter; (ii) a 2D or linear quadrupole ion trap; (iii) a Paul or 3D quadrupole ion trap; (iv) a Penning ion trap; (v) an ion trap; (vi) a magnetic sector mass filter; (vii) a Time of Flight mass filter; and (viii) a Wien filter; and/or (k) a device or ion gate for pulsing ions; and/or (l) a device for converting a substantially continuous ion beam into a pulsed ion beam.

The mass spectrometer may further comprise either:

(i) a C-trap and a mass analyser comprising an outer barrel-like electrode and a coaxial inner spindle-like electrode that form an electrostatic field with a quadro-logarithmic potential distribution, wherein in a first mode of operation ions are transmitted to the C-trap and are then injected into the mass analyser and wherein in a second mode of operation ions are transmitted to the C-trap and then to a collision cell or Electron Transfer Dissociation device wherein at least some ions are fragmented into fragment ions, and wherein the fragment ions are then transmitted to the C-trap before being injected into the mass analyser; and/or (ii) a stacked ring ion guide comprising a plurality of electrodes each having an aperture through which ions are transmitted in use and wherein the spacing of the electrodes increases along the length of the ion path, and wherein the apertures in the electrodes in an upstream section of the ion guide have a first diameter and wherein the apertures in the electrodes in a downstream section of the ion guide have a second diameter which is smaller than the first diameter, and wherein opposite phases of an AC or RF voltage are applied, in use, to successive electrodes.

According to an embodiment the mass spectrometer further comprises a device arranged and adapted to supply an AC or RF voltage to the electrodes. The AC or RF voltage preferably has an amplitude selected from the group consisting of: (i) <50 V peak to peak; (ii) 50-100 V peak to peak; (iii) 100-150 V peak to peak; (iv) 150-200 V peak to peak; (v) 200-250 V peak to peak; (vi) 250-300 V peak to peak; (vii) 300-350 V peak to peak; (viii) 350-400 V peak to peak; (ix) 400-450 V peak to peak; (x) 450-500 V peak to peak; and (xi) >500 V peak to peak.

The AC or RF voltage preferably has a frequency selected from the group consisting of: (i) <100 kHz; (ii) 100-200 kHz; (iii) 200-300 kHz; (iv) 300-400 kHz; (v) 400-500 kHz; (vi) 0.5-1.0 MHz; (vii) 1.0-1.5 MHz; (viii) 1.5-2.0 MHz; (ix) 2.0-2.5 MHz; (x) 2.5-3.0 MHz; (xi) 3.0-3.5 MHz; (xii) 3.5-4.0 MHz; (xiii) 4.0-4.5 MHz; (xiv) 4.5-5.0 MHz; (xv) 5.0-5.5 MHz; (xvi) 5.5-6.0 MHz; (xvii) 6.0-6.5 MHz; (xviii) 6.5-7.0 MHz; (xix) 7.0-7.5 MHz; (xx) 7.5-8.0 MHz; (xxi) 8.0-8.5 MHz; (xxii) 8.5-9.0 MHz; (xxiii) 9.0-9.5 MHz; (xxiv) 9.5-10.0 MHz; and (xxv) >10.0 MHz.

The mass spectrometer may also comprise a chromatography or other separation device upstream of an ion source. According to an embodiment the chromatography separation device comprises a liquid chromatography or gas chromatography device. According to another embodiment the separation device may comprise: (i) a Capillary Electrophoresis ("CE") separation device; (ii) a Capillary Electrochromatography ("CEC") separation device; (iii) a substantially rigid ceramic-based multilayer microfluidic substrate ("ceramic tile") separation device; or (iv) a supercritical fluid chromatography separation device.

The mass spectrometer may comprise a chromatography detector.

The chromatography detector may comprise a destructive chromatography detector preferably selected from the group consisting of: (i) a Flame Ionization Detector ("FID"); (ii) an aerosol-based detector or Nano Quantity Analyte Detector ("NQAD"); (iii) a Flame Photometric Detector ("FPD"); (iv) an Atomic-Emission Detector ("AED"); (v) a Nitrogen Phosphorus Detector ("NPD"); and (vi) an Evaporative Light Scattering Detector ("ELSD").

Additionally or alternatively, the chromatography detector may comprise a non-destructive chromatography detector preferably selected from the group consisting of: (i) a fixed or variable wavelength UV detector; (ii) a Thermal Conductivity Detector ("TCD"); (iii) a fluorescence detector; (iv) an Electron Capture Detector ("ECD"); (v) a conductivity monitor; (vi) a Photoionization Detector ("PID"); (vii) a Refractive Index Detector ("RID"); (viii) a radio flow detector; and (ix) a chiral detector.

The ion guide is preferably maintained at a pressure selected from the group consisting of: (i) <0.0001 mbar; (ii) 0.0001-0.001 mbar; (iii) 0.001-0.01 mbar; (iv) 0.01-0.1 mbar; (v) 0.1-1 mbar; (vi) 1-10 mbar; (vii) 10-100 mbar; (viii) 100-1000 mbar; and (ix) >1000 mbar.

According to an embodiment analyte ions may be subjected to Electron Transfer Dissociation ("ETD") fragmentation in an Electron Transfer Dissociation fragmentation device. Analyte ions are preferably caused to interact with ETD reagent ions within an ion guide or fragmentation device.

According to an embodiment in order to effect Electron Transfer Dissociation either: (a) analyte ions are fragmented or are induced to dissociate and form product or fragment ions upon interacting with reagent ions; and/or (b) electrons are transferred from one or more reagent anions or negatively charged ions to one or more multiply charged analyte cations or positively charged ions whereupon at least some of the multiply charged analyte cations or positively charged ions are induced to dissociate and form product or fragment ions; and/or (c) analyte ions are fragmented or are induced to dissociate and form product or fragment ions upon interacting with neutral reagent gas molecules or atoms or a non-ionic reagent gas; and/or (d) electrons are transferred from one or more neutral, non-ionic or uncharged basic gases or vapours to one or more multiply charged analyte cations or positively charged ions whereupon at least some of the multiply charged analyte cations or positively charged ions are induced to dissociate and form product or fragment ions; and/or (e) electrons are transferred from one or more neutral, non-ionic or uncharged superbase reagent gases or vapours to one or more multiply charged analyte cations or positively charged ions whereupon at least some of the multiply charge analyte cations or positively charged ions are induced to dissociate and form product or fragment ions;

and/or (f) electrons are transferred from one or more neutral, non-ionic or uncharged alkali metal gases or vapours to one or more multiply charged analyte cations or positively charged ions whereupon at least some of the multiply charged analyte cations or positively charged ions are induced to dissociate and form product or fragment ions; and/or (g) electrons are transferred from one or more neutral, non-ionic or uncharged gases, vapours or atoms to one or more multiply charged analyte cations or positively charged ions whereupon at least some of the multiply charged analyte cations or positively charged ions are induced to dissociate and form product or fragment ions, wherein the one or more neutral, non-ionic or uncharged gases, vapours or atoms are selected from the group consisting of: (i) sodium vapour or atoms; (ii) lithium vapour or atoms; (iii) potassium vapour or atoms; (iv) rubidium vapour or atoms; (v) caesium vapour or atoms; (vi) francium vapour or atoms; (vii) $C_{60}$ vapour or atoms; and (viii) magnesium vapour or atoms.

The multiply charged analyte cations or positively charged ions preferably comprise peptides, polypeptides, proteins or biomolecules.

According to an embodiment in order to effect Electron Transfer Dissociation: (a) the reagent anions or negatively charged ions are derived from a polyaromatic hydrocarbon or a substituted polyaromatic hydrocarbon; and/or (b) the reagent anions or negatively charged ions are derived from the group consisting of: (i) anthracene; (ii) 9,10 diphenylanthracene; (iii) naphthalene; (iv) fluorine; (v) phenanthrene; (vi) pyrene; (vii) fluoranthene; (viii) chrysene; (ix) triphenylene; (x) perylene; (xi) acridine; (xii) 2,2' dipyridyl; (xiii) 2,2' biquinoline; (xiv) 9-anthracenecarbonitrile; (xv) dibenzothiophene; (xvi) 1,10'-phenanthroline; (xvii) 9' anthracenecarbonitrile; and (xviii) anthraquinone; and/or (c) the reagent ions or negatively charged ions comprise azobenzene anions or azobenzene radical anions.

According to a particularly preferred embodiment the process of Electron Transfer Dissociation fragmentation comprises interacting analyte ions with reagent ions, wherein the reagent ions comprise dicyanobenzene, 4-nitrotoluene or azulene.

BRIEF DESCRIPTION OF THE DRAWINGS

Various embodiments of the present invention will now be described, by way of example, together with other arrangements given for illustrative purposes only and with reference to the accompanying drawings in which.

DETAILED DESCRIPTION OF PREFERRED EMBODIMENTS

A conventional ion inlet assembly will now be described.

Figure 1:
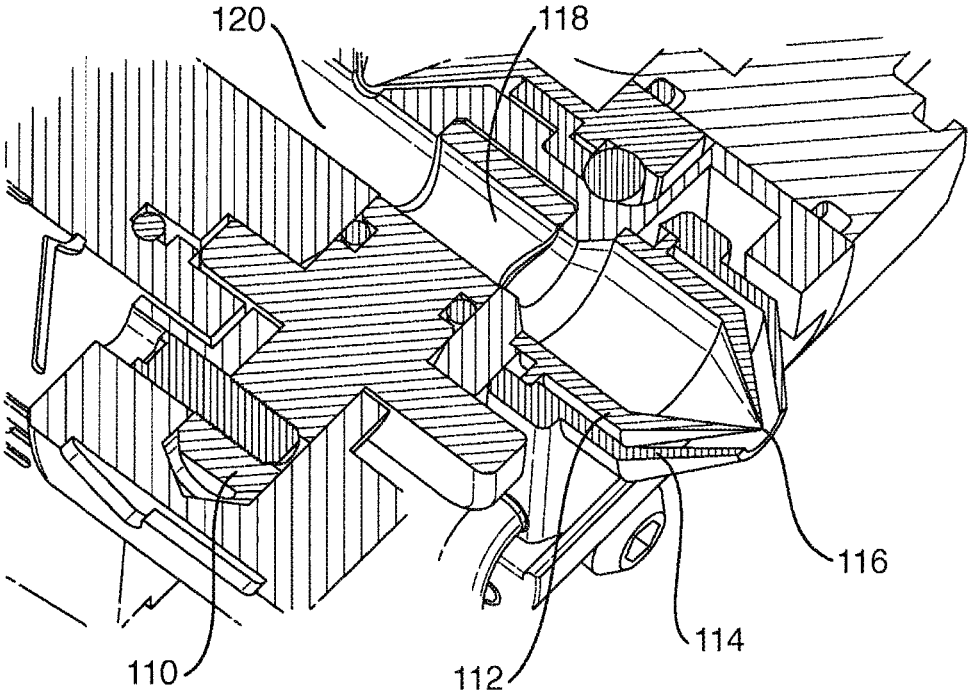
Fig. 1 Prior Art
FIG. 1 shows a conventional ion inlet assembly.

FIG. 1 shows a conventional ion inlet assembly 110. The conventional arrangement comprises an outer gas cone 114 and an inner gas cone 112 of similar form which are nested together so that the angles and hole diameters may be varied to fit machine performance. The outer gas cone 114 comprises a high precision machined component with stringent cleaning requirements. The outer gas cone 114 is followed by an inner gas cone 112. These parts are high cost and the orifice 116 in the inner gas cone 112 is prone to being damaged and/or at least partially blocked. In particular, the orifice 116 in the inner gas cone 112 may become partially blocked during cleaning and it can be difficult for a user to determine whether or not the orifice 116 is partially blocked.

The intersecting angles of the inner and outer gas cones 112,114 results in the formation of an entrance aperture 116. An isolation valve 118 is located downstream of the inner and outer gas cones 112,144. The isolation valve 118 is arranged to prevent a downstream vacuum chamber 120 from venting when the inlet assembly is removed. The isolation valve 118 is expensive to manufacture and requires the user to close it before the ion inlet assembly is removed in order to maintain analyser vacuum.

Figure 2:
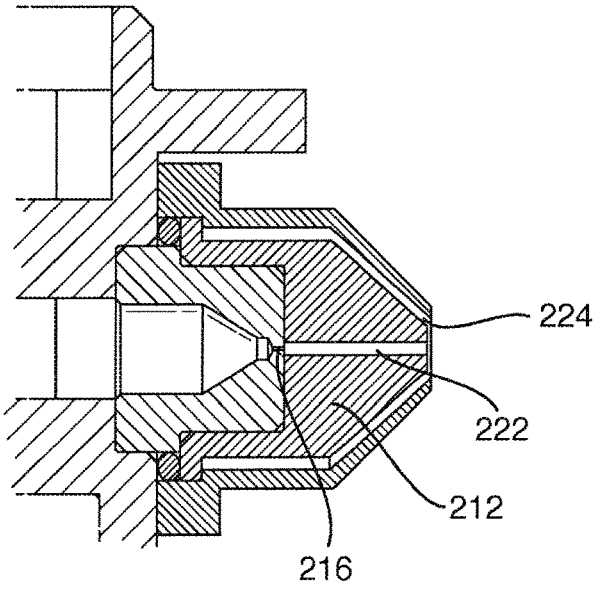
Fig. 2 Prior Art
FIG. 2 shows an alternative conventional ion inlet assembly having a reverse cone geometry.

FIG. 2 shows an alternative conventional ion inlet assembly having a reverse cone geometry. In this assembly the entrance aperture 216 is formed behind the gas cone 212. An aperture 222 through the gas cone 212 is provided.

An opening 224 about the centre of the cone can be obtained via a sharp intersection of two differing cone angles controlled to a height. The reverse cones require the drilling of a very small precise hole into the cone, part of which is then joined to the main body.

It will be understood by those skilled in the art that the arrangements shown in FIGS. 1 and 2 require precision turning and drilling processes which are highly expensive leading to a high cost component. Furthermore, the inner gas cone 112 as shown in FIG. 1 is particularly prone to being damaged and/or partially blocked.

The cones are required to be chemically robust and to withstand exposure to solvents during normal operation. In order to maintain this level of performance the cones must be regularly removed from the assembly and cleaned.

The removal of the cones will mean total loss of vacuum unless an isolation valve is provided. Furthermore, regularly cleaning exposes the cones to the risk of damage and it is not always easy to determine whether or not an orifice in one of the cones is partially blocked.

A preferred embodiment of the present invention will now be described.

Figure 3:
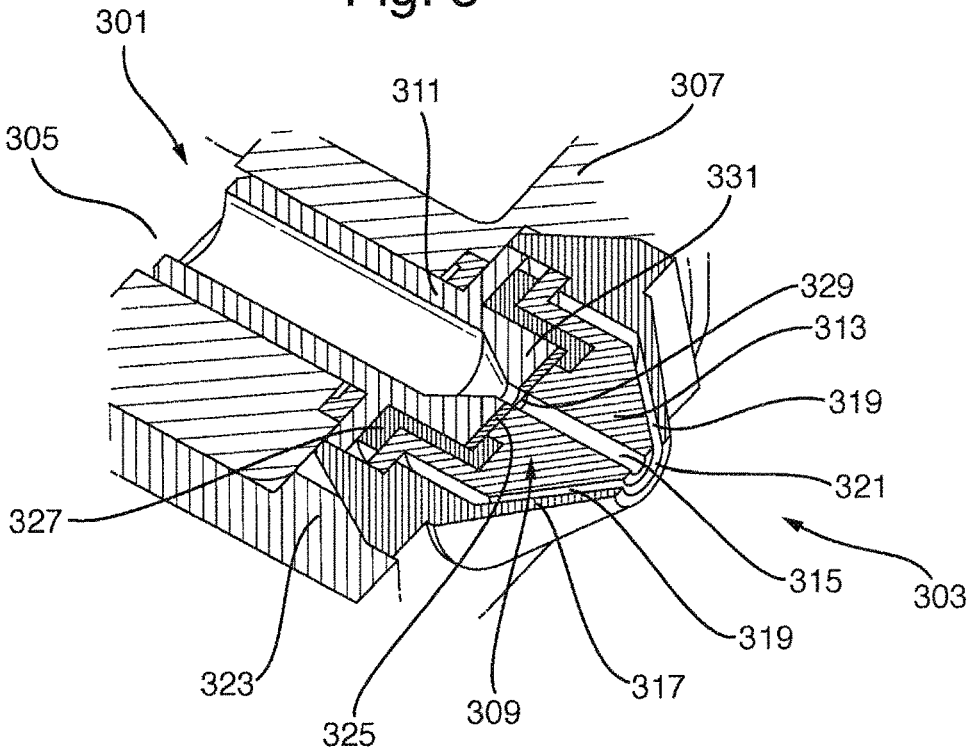
FIG. 3 shows an ion inlet assembly in accordance with a preferred embodiment of the present invention.

FIG. 3 shows a schematic of an ion inlet assembly for a mass spectrometer in accordance with an embodiment of the present invention. An ion source (not shown) is located in an external ionisation chamber 303 and analyte ions are directed to a vacuum chamber 305 of a mass spectrometer 301.

The ionisation chamber 303 is separated from the vacuum chamber 305 by a vacuum chamber wall 307. Ions from the ion source are directed towards the ion inlet assembly 309 which covers an aperture 311 in the vacuum chamber wall 307.

A gas cone structure comprises an inner gas cone body 313 with a central aperture 315 through the cone (at the point of the cone) and an outer gas cone 317. The outer gas cone 317 is arranged to provide a hollow area or annulus 319 between the inner gas cone 313 and the outer gas cone 317.

An outer gas cone aperture 321 is arranged in the outer gas cone 317 at the point of the cone.

The gas cone structure is arranged to allow for the gas cone to be connected to a gas port (not shown) which directs a flow of gas through the hollow area or annulus 319 between the inner gas cone 313 and the outer gas cone 317 and towards the outer gas cone aperture 321.

The outer gas cone 317 is preferably attached to the housing 323 of the instrument by means of a retaining device (not shown). The retaining device (not shown) is preferably arranged to hold the outer gas cone 317 in place and by holding the outer gas cone 317 in place, the inner gas cone 313 is preferably also held in place by the outer gas cone 317 resting upon it.

The retaining device is preferably designed to hold the sample cone arrangement in place without the need to use mechanical fasteners.

A sampling limiting body 325 in the form of a nickel electroformed disk is preferably arranged or otherwise secured within a sampling limiting body mounting 327. The sampling limiting body 325 is preferably attached beneath the inner gas cone 313 to the housing 323 such that the sampling limiting body mounting 327 and the sampling limiting body 325 cover the aperture 311 of the vacuum chamber 305.

The sampling limiting body 325 has an aperture or sampling orifice 329 through which ions can pass. The sampling limiting body mounting 327 and sampling limited body in the form of a disk 325 are arranged to sit upon the housing 323 and are removably held in position by the inner gas cone 313 resting upon the sampling limiting body mounting 327.

A vacuum holding member 331 is preferably arranged underneath the sampling limiting body 325 and the sampling limiting body mounting 327. The vacuum holding member 331 is preferably arranged to cover the aperture 311 of the vacuum chamber 305 and is attached to the housing 323 by the sampling limiting body mounting 327 resting upon the vacuum holding member 331. Upon removal of the sampling limiting body 325 and the sampling limiting body mounting 327, the vacuum holding member 331 will preferably remain being held in place without the sampling limiting body 325 and the sampling limiting body mounting 327 resting upon the vacuum holding member 331 when the instrument remains at sufficient vacuum level which will prevent complete loss of internal vacuum pressure. This reduces the time taken for the instrument to return to an operational state after the sample limiting body 325 has been replaced.

The gas cone structure preferably comprises an outer gas cone 317 and an inner gas cone 313 which are two separate structures. The manufacture of the gas cone structure as two separate structures is relatively easy to manufacture and clean. However, according to a less preferred embodiment the gas cone structure may comprise a single structure.

The gas cone structure is preferably held in place by a retaining device which is designed to hold the sample cone arrangement in place without the need to use mechanical fasteners such as screws or Allen bolts. This removes the possibility of the failure of such fasteners or of a user applying insufficient or incorrect tension to such fasteners. Advantageously, no tools are preferably required by a user in order to attach and secure the gas cone assembly to an ion block of the mass spectrometer.

Less preferred embodiments are nonetheless contemplated wherein the gas cone is still be held in place with the use of mechanical fasteners, screws or Allen bolts.

According to the preferred embodiment the central aperture in the outer gas cone 317 is preferably in the range 2-4 mm. According to less preferred embodiments the central aperture in the outer gas cone 317 may be in the range 0.5 to 10 mm.

The central aperture in the inner gas cone 313 is preferably in the range 0.5 to 1.5 mm. According to less preferred embodiments the central aperture in the inner gas cone 313 may be in the range 0.1 to 5 mm.

Figure 4:
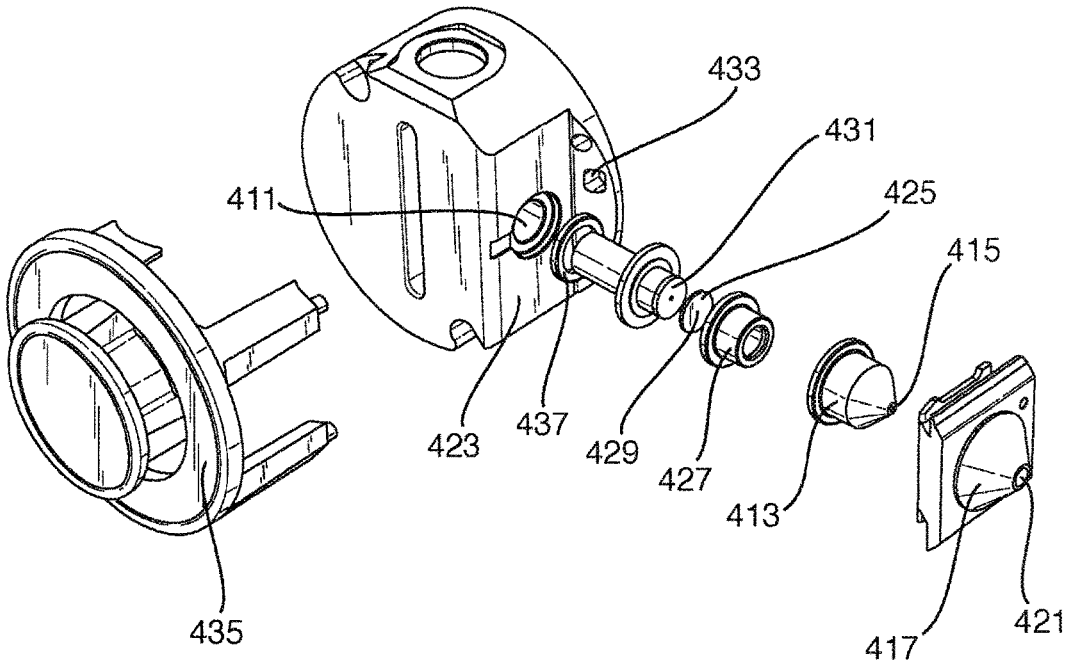
FIG. 4 shows an exploded view of an ion inlet assembly according to a preferred embodiment of the present invention.

FIG. 4 shows an exploded view of an ion inlet assembly according to a preferred embodiment of the present invention. The gas cone structure comprises an inner gas cone body 413 with a central aperture 415 through the cone at the point of the cone. An outer gas cone 417 is provided and provides a hollow area or annulus (not shown) between the inner gas cone 413 and the outer gas cone 417.

An outer gas cone aperture 421 is arranged in the outer gas cone 417 at the point of the cone. The gas cone structure is arranged to allow the attachment to a gas port 433. The gas port 433 directs a gas flow through the hollow area or annulus (not shown) between the inner gas cone 413 and the outer gas cone 417 and towards the aperture of the outer gas cone 421.

The outer gas cone 417 is preferably arranged to be attached to the housing 423 of the instrument by means of a retaining device 435. The retaining device 435 is preferably arranged to hold the outer gas cone 417 in place and by holding the outer gas cone 417 in place, the inner gas cone 413 is preferably also held in place by the outer gas cone 417 resting upon it.

The retaining device 435 is preferably arranged to hold the sample cone arrangement in place without the need to use mechanical fasteners.

The sampling limiting body 425 preferably comprises an electroformed nickel disk and is preferably arranged or otherwise mounted in a sampling limiting body mounting 427. The sampling limiting body mounting 427 is preferably arranged to be attached beneath the inner gas cone 413 to the housing 423, such that the sampling limiting body mounting 427 and the sampling limiting body 425 cover the aperture 411 of the vacuum chamber.

The sampling limiting body comprising a disk has an aperture 429 through which ions can pass. The sampling limiting body mounting 427 and the sampling limiting body 425 are preferably arranged to sit upon the housing 423 and can be removably held in place by the inner gas cone 413 resting upon the sampling limiting body mounting 427.

A vacuum holding member 431 is preferably arranged underneath the sampling limiting body 425 and the sampling limiting body mounting 427. The vacuum holding member 431 is preferably arranged to cover the aperture 411 of the vacuum chamber and is capable of attachment to the housing 423 by the sampling limiting body mounting 427 resting upon the vacuum holding member 431. Upon removal of the sampling limiting body 425 and the sampling limiting body mounting 427, the vacuum holding member 431 will preferably remain in place without the sampling limiting body 427 resting upon the vacuum holding member 431 when the instrument is held at vacuum by the pressure differential created by the vacuum chamber (not visible) being at lower pressure than the ionisation chamber.

A washer 437 is preferably arranged to form a seal between the vacuum holding member 431 and the housing 423.

Figure 5:
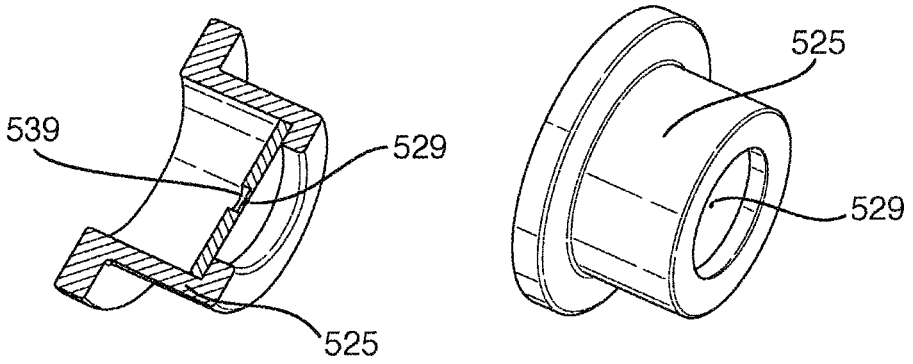
FIG. 5 shows a sampling limiting body housed within a sampling limiting body housing in accordance with an embodiment of the present invention.

FIG. 5 shows a sampling limiting body in accordance with an embodiment of the present invention. The sampling limiting body comprises a nickel electroformed disk which is mounted within a sampling limiting body housing 525 so that the sampling limiting body can be secured relative to the vacuum housing (not shown).

The sampling limiting body may have stepped geometry 539 through the thickness of the aperture orifice 529.

The sampling limiting body is preferably substantially flat in form and is produced or otherwise formed by using an additive electroforming manufacturing processes rather than being machined from solid stock material. The disk forms a gas limiting orifice and is made from nickel by an electroforming processes which is particularly advantageous relative to conventional arrangements.

According to an embodiment the sampling limiting body comprising a disk may be grown complete in a single process and preferably requires no further finishing. The disk may be manufactured with an internal aperture having various different forms or profiles. The internal aperture preferably comprises a round or circular aperture although other embodiments are contemplated wherein the aperture may have other different geometries. According to an embodiment the internal aperture may be formed so as to have rifling i.e. helical grooves.

Embodiments are contemplated wherein more than one aperture may be provided in the sampling limiting body or disk in order to allow greater throughput of sample into the mass spectrometer. The one or more apertures are preferably arranged on or around the central axis.

According to other less preferred embodiments the one or more apertures may be arranged off the central axis.

A particularly advantageous aspect of the present invention is that by electroforming the sampling limiting body from nickel, the aperture size in the nickel disk can be precisely and consistently manufactured. The manufacturing process is, advantageously, highly repeatable.

One of the main advantages of the electroforming process which is utilised according to the present invention is that the low cost of fabricating the sampling limiting body allows the sampling limiting body to become essentially a disposable item. The disposable nature of the sampling limiting body according to the preferred embodiment essentially negates the need to clean or service the part.

According to the preferred embodiment the sampling limiting body and the corresponding sampling limiting body housing 525 may be easily removed. Easy removal of the sampling limiting body and the corresponding sampling limiting body housing 525 is achieved by the pinching removal of the housing. The two parts can then be discarded and replaced at low cost as a complete unit. According to an alternative embodiment only the sampling limiting body need be discarded or otherwise replaced.

The sampling limiting body housing 525 is preferably made of synthetic rubber such as VITON® although other embodiments are contemplated wherein the sampling limiting body housing 525 may be made from a polymeric material.

The sampling limiting body housing 525 is preferably pliable so that the sampling limiting body can be manipulated to sit on top of the housing of the mass spectrometer and create a seal against it.

The sampling limiting body housing 525 is preferably made of an electrically conductive material so that, when in use, an electric current may be applied through the housing to the sampling limiting body from connections on the vacuum housing.

The sampling limiting body housing 525 is preferably arranged to form an interference fit with the sampling limiting body or disk. In particular, the outer diameter of the sampling limiting body or disk is preferably arranged to be slightly larger than the inner diameter of the sampling limiting body housing 525. The conductive flexible sampling limiting body housing 525 preferably ensures that a gas tight seal is formed with the sampling limiting body or disk. Furthermore, since the sampling limiting body housing 525 is preferably conductive, then electrical contact can be readily established between the nickel sampling limiting body and an ion block of a mass spectrometer via the sampling limiting body housing 525. The tight interference fit between the sampling limiting body and the sampling limiting body housing 525 has also been found to provide improved electrical conductivity.

Figure 6:
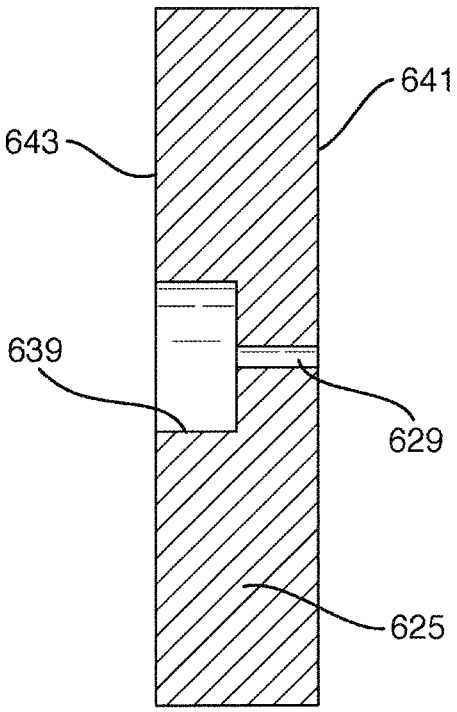
FIG. 6 shows a cross-sectional view of a sampling limiting body in accordance with an embodiment of the present invention.

FIG. 6 shows a sampling limiting body 625 in accordance with a preferred embodiment of the invention. The sampling limiting body 625 is preferably in the form of a disk. According to an embodiment the disk may have a polished front (outer) surface 641 and a second rear (inner) matt surface 643. The polished surface 641 is preferably arranged to sit against the sampling limiting body housing (not shown) and preferably faces towards the gas cone structure. The second matt face 643 preferably has a stepped surface 639. The aperture for the transmittal of ions is preferably arranged to be inside the stepped surface so that the aperture 629 is at the point where the sampling limiting body 625 is of least diameter. This reduces the likelihood of blockages.

Other embodiments are contemplated wherein the outer surface 641 may comprise a matt surface and/or the inner surface 643 may comprise a polished surface. According to other embodiments both surfaces may comprise matt surfaces or polished surfaces. The outer surface 641 may be stepped and/or the inner surface 643 may be flat. In some embodiments both surfaces may be stepped or flat.

The sampling limiting body is preferably nickel grown. According to less preferred embodiments the sampling limiting body may be made from stainless steel or aluminum.

The sampling limiting body may be coated with, for example, gold or another electrically conductive material. In other embodiments the sampling limiting body may be made using a laser machining processes.

In some embodiments information relating to the sampling limiting body may be added to one or both surfaces. According to the preferred embodiment visual information is preferably displayed on the outer shiny surface.

The sampling limiting body preferably comprises a flat disk, further preferably a stepped disk. According to other less preferred embodiments the sampling limiting body may be concave or convex in form.

The stepped disk may include one or more stepped levels on either or both sides of the sampling limiting body. The stepped levels may have rounded or pointed corners.

The flat disk is preferably substantially round or circular but according to less preferred embodiments the flat disk may have a different geometry.

The flat disk may be shaped so that it is keyed to ensure that the disk is used for the appropriate instrument thereby avoiding accidental installation or insertion within a wrong or unsuitable instrument.

Embodiments of the present invention are contemplated wherein multiple orifices are provided in the sampling limiting body.

Embodiments are contemplated wherein the area of one or more orifices is preferably in the range of 2000 $\mu m^2$ to 13

$mm^2$. The area of the orifice preferably depends upon the requirements for the vacuum system of the mass spectrometer in question. According to a particularly preferred embodiment the area of the orifice is preferably in the range of 30000 to 125000 $\mu m^2$.

According to an embodiment multiple holes may be provided in the sampling limiting body. For example, 2, 3, 4, 5, 6, 7, 8, 9, 10, 11, 12, 13, 14, 15 or more than 15 holes or orifices may be provided in the sampling limiting body. Preferably, the combined area of all the holes or apertures is in the range of 2000 $\mu m^2$ to 13 $mm^2$.

According to other embodiments the area of the orifice(s) is preferably in the range of 30000 to 125000 $\mu m^2$.

The sampling limiting body aperture preferably has a diameter in the range of 100-200 μm. According to other embodiments the sampling limiting body aperture may have a diameter in the range of 50-2000 μm.

Preferably, the sampling limiting body has a diameter in the range of 3-15 mm. According to other further embodiments the sampling limiting body may have a diameter in the range of 1-25 mm.

The sampling limiting body preferably has a thickness in the range of 0.2-1 mm. In further embodiments the sampling limiting body preferably has a thickness in the range of 0.1-3 mm.

The vacuum holding member is preferably arranged to hold a vacuum when the sampling limiting body and gas cone assembly has been removed. This advantageously removes the need for an isolation valve to be provided and thereby reduces the manufacturing cost of the mass spectrometer.

According to a particularly preferred embodiment the disk has a diameter of 7 mm and a thickness of 0.5 mm. According to an embodiment the sampling limiting body aperture or orifice 629 may have a diameter in the range 90-200 μm. For example, disks having an orifice 629 diameter of 90 μm and 200 μm may be used.

Although not shown in FIG. 6, the disk may be electroformed so that the aperture or orifice 629 is provided in a single build layer of the electroforming process. According to an embodiment, the single build layer may have a thickness of 25 μm. Accordingly, a disk 625 may be provided which is 5 mm thick and wherein a rear bore 639 having a diameter of 1 mm extends for 4.975 mm so that the aperture or orifice 629 is formed in a single build layer having a thickness of 0.025 mm. Although the aperture or orifice 629 can be formed in a thin single build layer, the disk 625 has been found to be robust and to possess an exceptional degree of consistency during the manufacturing process.

Figure 7:
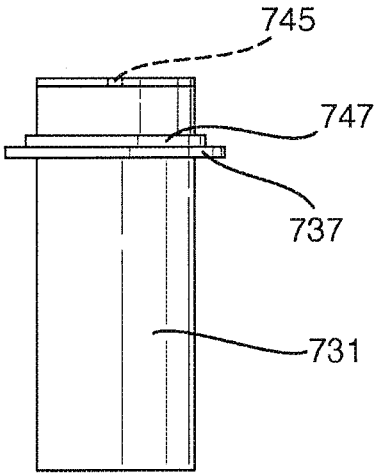
FIG. 7 shows a vacuum holding member in accordance with a preferred embodiment of the present invention.

FIG. 7 shows in greater detail the vacuum holding member 731. The vacuum holding member 731 preferably has an aperture 745 in the surface facing towards the sampling limiting body (not shown) for the ions to pass through. The vacuum holding member 731 preferably has a ridge 747 which holds a washer 737 in place. When attached to the ion inlet system (not shown), the washer 737 preferably sits against the entrance of the ion inlet system (not shown) creating a seal with the housing (not shown). When in place, the vacuum holding member 731 preferably provides a vacuum seal with the ion inlet entrance (not shown) to prevent the ion inlet system (not shown) from being open to the atmosphere and resulting in the whole instrument venting.

The vacuum holding member aperture preferably has a diameter in the range of 0.3 to 5 mm. In further embodiments the vacuum holding member aperture may have a diameter in the range of 0.1-10 mm.

In addition to holding a vacuum upon the removal of the sampling limiting body, an additional benefit of the vacuum holding member 731 is that it also helps to keep the main ion inlet in the ion block clean.

Although the present invention has been described with reference to preferred embodiments, it will be understood by those skilled in the art that various changes in form and detail may be made without departing from the scope of the invention as set forth in the accompanying claims.

The invention claimed is:

1. An ion inlet assembly for connecting to a mass spectrometer housing comprising:

a gas cone assembly having a gas cone orifice;

a sampling limiting body comprising a flat nickel disk and having a sampling orifice, wherein said flat disk and said sampling orifice are made or formed by an electroforming process; and a sampling limiting body housing;

wherein the sampling limiting body is removably attachable beneath the gas cone assembly to the sampling limiting body housing;

wherein said sampling limiting body housing and said sampling limiting body are removably attached to said mass spectrometer housing by said gas cone assembly resting upon said sampling limiting body housing.

2. An ion inlet assembly as claimed in claim 1, wherein said gas cone assembly is connectable to a gas supply such that gas is arranged to flow, in use, towards said gas cone orifice.

3. An ion inlet assembly as claimed in claim 1, wherein said electroformed nickel disk is substantially round or circular.

4. An ion inlet assembly as claimed in claim 1, wherein said sampling limiting body housing is made of rubber.

5. An ion inlet assembly as claimed in claim 1, wherein said sampling limiting body housing is electrically conductive.

6. An ion inlet assembly as claimed in claim 1, wherein said sampling limiting body is arranged to be supplied with a voltage in use.

7. An ion inlet assembly as claimed claim 1, wherein said sampling orifice is substantially round or circular.

8. An ion inlet assembly as claimed claim 1, wherein said sampling limiting body comprises a plurality of sampling orifices.

9. An ion inlet assembly as claimed in claim 1, further comprising a vacuum holding member having an orifice to allow the flow of ions into a mass spectrometer.

10. An ion inlet assembly as claimed in claim 1, wherein said ion inlet assembly is attached, in use, to a mass spectrometer housing by a mounting device.

11. An ion inlet assembly as claimed in claim 10, wherein said mounting device is attached, in use, to a mass spectrometer housing without mechanical fasteners.

12. A mass spectrometer comprising an ion inlet assembly as claimed in claim 1.

13. An ion inlet assembly as claimed in claim 1, wherein said disk is not round or is non-circular.

14. An ion inlet assembly as claimed in claim 1, wherein said sampling limiting body housing is arranged to form an interference fit with said sampling limiting body.

15. An ion inlet assembly as claimed in claim 1, wherein said electroformed nickel disk has a polished surface that is arranged to face towards said gas cone assembly.

16. An ion inlet assembly for connecting to a mass spectrometer housing comprising:

a gas cone assembly having a gas cone orifice;

a sampling limiting body comprising a flat disk having an orifice, wherein said sampling limiting body is made of nickel, and wherein said sampling limiting body and the orifice are made by an electroforming process, wherein the sampling limiting body is removably attachable beneath the gas cone assembly to the housing;

a sampling limiting body housing, wherein said sampling limiting body housing and said sampling limiting body are removably attached to said mass spectrometer housing by said gas cone assembly resting upon said sampling limiting body housing; and a vacuum holding member having an orifice to allow the flow of ions into the mass spectrometer, wherein said vacuum holding member is arranged underneath the sampling limiting body;

wherein upon attachment to a mass spectrometer housing said vacuum holding member provides at least a partial vacuum seal upon removal of the sampling limiting body.

17. An ion inlet assembly as claimed in claim 16, wherein said sampling limiting body comprises a disk.

18. An ion inlet assembly as claimed in claim 16, wherein said gas cone assembly is arranged to connect to a gas supply so that gas is arranged to flow towards said orifice in use.

19. An ion inlet assembly as claimed in claim 18, wherein said gas cone orifice is configured to allow ions to pass therethrough.

20. A method of manufacturing an ion inlet assembly for and connecting said ion inlet assembly to a mass spectrometer housing, said ion inlet assembly comprising a gas cone assembly having a gas cone orifice, a sampling limiting body, and a sampling limiting body housing, said method comprising:

using an electroforming process to form the sampling limiting body comprising a flat nickel disk having a sampling orifice, wherein the electroforming process is used to form the flat nickel disk and the sampling orifice; and removably attaching said sampling limiting body beneath the gas cone assembly to the sampling limiting body housing by removably attaching said sampling limiting body housing and said sampling limiting body to said mass spectrometer housing by resting said gas cone assembly upon said sampling limiting body housing.

* * * * *